United States Patent [19]

Hoger et al.

[11] 3,982,885

[45] Sept. 28, 1976

[54] METHOD AND ARRANGEMENT FOR INHOMOGENEOUS ANNEALING OF SMALL PARTS

[75] Inventors: Karl Hoger, Kornwestheim; Wolfgang Grobe, Ludwigsburg, both of Germany

[73] Assignee: International Standard Electric Corporation, New York, N.Y.

[22] Filed: Dec. 2, 1974

[21] Appl. No.: 528,605

[30] Foreign Application Priority Data

Dec. 7, 1973 Germany ..... 2361184

[52] U.S. Cl. ..... 432/24; 13/34; 432/202; 432/245

[51] Int. Cl.[2] ..... F27D 7/00; F27D 11/06

[58] Field of Search ..... 432/24, 432/153, 202, 245, 249, 226; 165/135; 13/34

[56] References Cited

UNITED STATES PATENTS

| | | | |
|---|---|---|---|
| 395,164 | 12/1888 | Meyer | 432/226 |
| 1,794,863 | 3/1931 | Northrup | 13/34 |
| 1,799,102 | 3/1931 | Kelley | 13/34 X |
| 2,593,015 | 4/1952 | Dreher | 432/249 |
| 3,704,871 | 12/1972 | Paulson | 432/226 |

*Primary Examiner*—John J. Camby
*Attorney, Agent, or Firm*—John T. O'Halloran; Thomas M. Marshall

[57] ABSTRACT

An arrangement for providing controlled annealing of parts within a furnace comprising a series of heat radiation distributors, thermal conduction dosing devices and heat accumulators positioned within the furnace to provide a temperature gradient in the radial direction of the furnace cross section. The controlled temperature distribution within the furnace provides a controlled temperature distribution to the objects within the furnace during the annealing process. This controlled annealing process is particularly applicable to a method for controlling the coercive force distribution within a magnetically hard reed armature for matching the coercive force distribution along the armature to the magnetic flux intensity of the reed contact assembly.

10 Claims, 5 Drawing Figures

METHOD AND ARRANGEMENT FOR INHOMOGENEOUS ANNEALING OF SMALL PARTS

BACKGROUND OF THE INVENTION

Methods for effecting partial areas of small workpieces by subjecting the workpieces to high-frequency annealing, irradiation, or heat treatment by means of electron or laser beam devices are well known. By employing local heating it is also possible to produce a particular inhomogeneity in the material of the workpiece. Whenever great numbers of pieces are to be processed or whenever longer periods of time are required for annealing, however, these known processes become too expensive to be practical.

The purpose of this invention is therefore to provide a method and apparatus for the economical inhomogeneous annealing of large numbers of precision-engineering workpieces.

SUMMARY OF THE INVENTION

It is an object of this invention, therefore, to provide an arrangement for inhomogeneous annealing by which the desired temperature distribution is effected in the parts to be annealed. According to the invention this is accomplished by means of a protective atmosphere tubular annealing furnace, heat radiation distributors, thermal conduction dosing devices and heat accumulators arranged inside the tubular annealing furnace for producing a temperature field with a gradient in the radial direction of the tubular annealing furnace within the range of the object to be annealed.

The type of construction according to the invention is based on the conventional protective atmosphere tubular annealing furnace. In such a furnace the temperature is chiefly varied along the axis of the tubular part of the annealing furnace. By using the described arrangement a suitable temperature gradient is also produced in the radial direction of the tubular part of the annealing furnace. The thermionic flow (heat current) inside the tubular part of the annealing furnace may be either stationary or dynamic. Accordingly, both applying and carrying-off the thermionic flow is effected by radiation, convection and/or conduction. This may be done in different ways. In the case of the dynamic setting of gradient fields, for example, the restricted annealing period is used for heating up heat accumulators which, for a restricted period of time, serve as heat sinks. The time constant of the heat accumulators must be approximately equivalent to the required annealing period. Another method is the insertion of heat accumulators into the structure providing the thermionic flow distribution.

The instant invention further provides the advantage of annealing large number of small precision-engineering workpieces economically in a field of temperature gradient, since both the methods of applying and of carrying-off the thermionic flow are capable of localizing within areas which are smaller than the largest dimensions of the objects to be annealed.

DESCRIPTION OF THE PREFERRED EMBODIMENT

Figure 1:
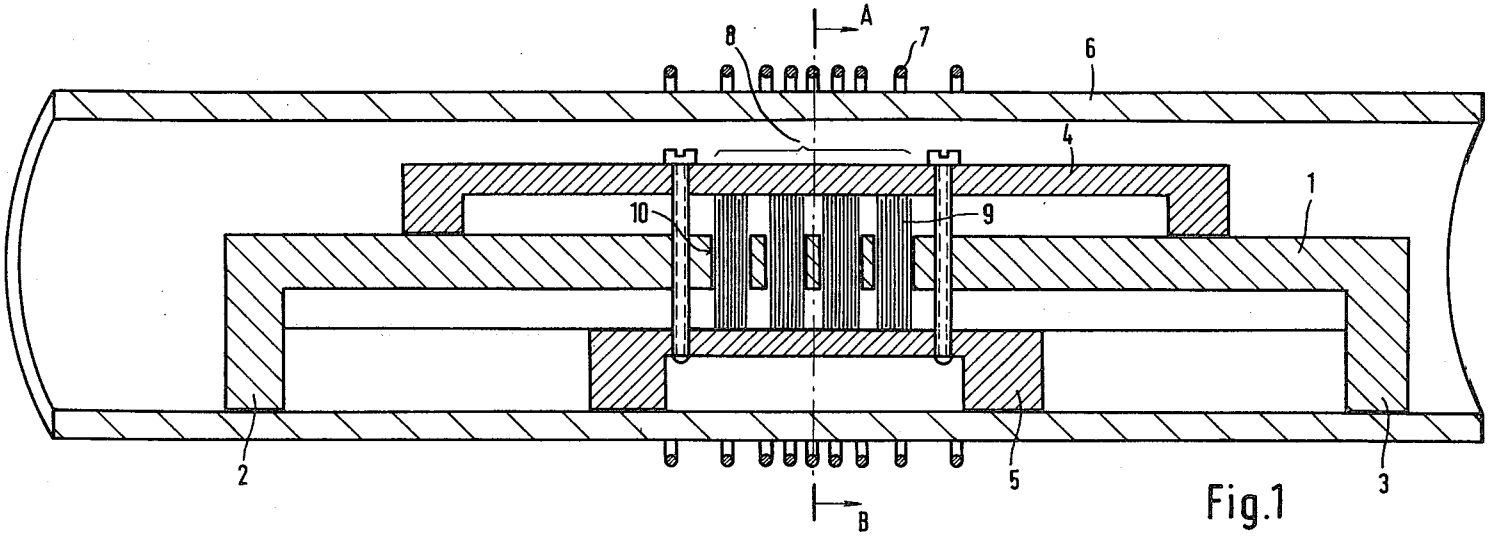
FIG. 1 is a sectional view of the tubular part of a protective-atmosphere tubular annealing furnace.
Figure 2:
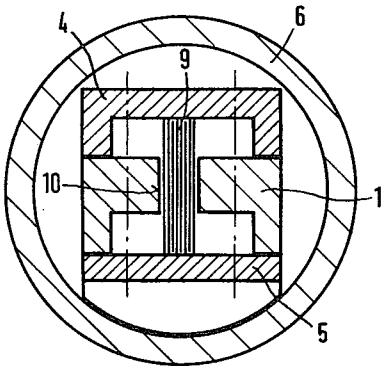
FIG. 2 is a section taken through the line A–B of the furnace of FIG. 1.

FIGS. 1 and 2 are the sectional views of the tubular part 6 of a tubular annealing furnace inside of which a heat bridge 1 is arranged to extend in the longitudinal direction. This heat bridge 1 is supported on two base members (stands) 2 and 3 adapted to the shape of the tubular part 6. The objects 9 to be annealed, such as reed contact armatures for the use in reed contact tubes are arranged in bundles and positioned in recesses 10 provided for in the heat bridge 1. In so doing, the area of the objects 9 to be annealed at a reduced temperature, is tightly enclosed by the heat bridge 1. The heat bridge 1 is extended beyond the annealing zone of the tubular part 6 of the annealing furnace, and thus stretches into the cooling zone of the furnace. The heat bridge, therefore, will not completely assume the temperature of the annealing zone. The shape and material of both the heat bridge 1 and the base members 2 and 3 are chosen such that depending on the heat (thermal) conductivity of the material and the length of the annealing zone, required time constant for heating the objects to be annealed will occur. The heat bridge 1 supports a shielding 4 surrounding the area 8 of the objects to be annealed, on three sides, thus shielding the objects 9 to be annealed in the upward direction. The shielding 4 is in a close heat contact with the heat bridge 1 and thus controls irradiation within the area 8 of the objects to be annealed. The shape and substance of the heat bridge 1 are likewise co-determinative of the time constant for heating the objects to be annealed, and are chosen accordingly. The objects 9 to be annealed are supported by a heat input dosing member 5 arranged below the heat bridge 1 for dosing the heat input at that point. The arrangement inside the tubular part 6 of the annealing furnace, consisting of the heat bridge 1, the shielding 4 and the heat input dosing member 5 is designed to have such a shape, mass distribution and material composition so that the heat currents (thermionic flows) are distributed by irradiation, conduction and convection, and that the axial temperature gradient along the heat bridge 1 supporting the objects 9 to be annealed, will disappear, and that the radial temperature gradient will permit the desired temperature distribution along the parts to be annealed. An irregular winding of the heating coil 7 on the tubular part 6 of the annealing furnace contributes towards compensating for axial differences in temperature along the area 8 of the objects to be annealed.

Figure 3:
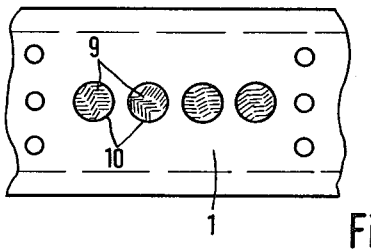
FIG. 3 is a top sectional view of the furnace of FIG. 1 showing the objects to be annealed.

FIG. 3 shows the part of the heat bridge 1 supporting the objects 9 to be annealed. The objects 9 to be annealed, e.g. reed contact armatures for the use in reed tubes, are arranged in bundles in the recesses (holes) 10.

Figures 4, 5:
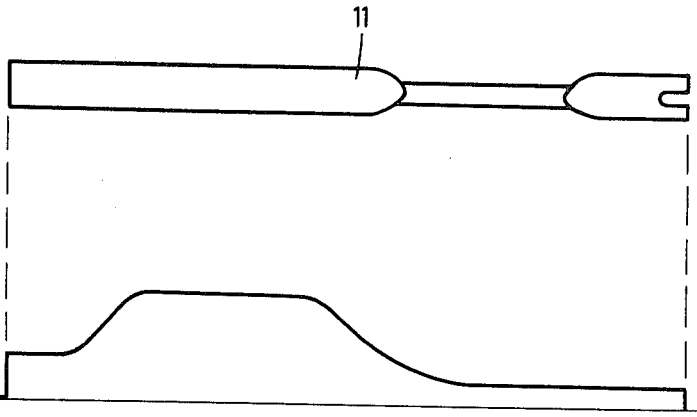
FIG. 4 is a perspective view of a reed contact armature.
FIG. 5 is a graphic illustration of the coercive force along the axis of the reed contact armature of FIG. 4.

One example of practical application relating to an inhomogeneous annealing within a field of temperature gradient will now be explained with reference to FIGS. 4 and 5 of the drawings. FIG. 4 shows a reed contact armature made from a reversible hard-magnetic material used for self-latching reed contacts. In the case of such a reed contact armature it is possible to adjust the coercive force irregularly along its longitudinal axis by means of inhomogeneous annealing. The diagram of FIG. 5 shows the curve of the coercive force $H_c$ as plotted over the reed contact armature after the latter has been subjected to an inhomogeneous annealing process in an arrangement similar to the one described with reference to FIGS. 1 to 3. In this way, for example, the magnetic length of the reed contact armature may be adapted economically to the length of its associated magnetizing coil.

What is claimed is:

1. An arrangement for the inhomogeneous annealing of parts comprising in combination:

a tubular annealing furnace;

a heat radiation distributor means within said furnace;

thermal conduction dosing means proximate said radiation distributor means; and heat accumulator means proximate both said distributor means and said conduction means for providing a temperature gradient in the radial direction within said furnace and for providing a temperature distribution range within said parts when placed within said arrangement.

2. The arrangement of claim 1 wherein said annealing furnace comprises an annealing zone and a cooling zone and wherein said heat accumulator means is a heat bridge device provided within said furnace, said heat bridge extending within both said annealing and cooling zones.

3. The arrangement of claim 2 further including a shielding member superjacent said heat bridge said shielding thereby providing thermal insulation in a top direction within said furnace.

4. The arrangement of claim 3 wherein said heat input dosing is located subjacent said heat bridge for providing heat dosing to parts placed within said heat bridge.

5. The arrangement of claim 2 wherein said heat bridge surrounds a region of said parts in order to provide annealing thereto said region of said parts at a reduced temperature.

6. The arrangement of claim 5 wherein said heat bridge further includes a plurality of means for positioning objects to be annealed therethrough said bridge.

7. The arrangement of claim 6 further including a plurality of objects located within a plurality of holes within said heat bridge.

8. The arrangement of claim 1 further including a plurality of heat coil windings surrounding said furnace wherein the spacing between the coil windings is varied to provide a temperature distribution pattern therewithin said furnace.

9. A method of annealing reversible hard magnetic reed contact armatures comprising the steps of:

locating said armature within an annealing furnace; and positioning a heat bridge within said furnace so that an intermediate portion of said armature is thermally shielded and the rest of said armature is unshielded to provide a temperature differential during annealing between said thermally shielded intermediate portion and said unshielded intermediate portion of said armature within said furnace.

10. A method of providing a differential coercive force distribution to reversible hard magnetic reed contact armatures comprising the steps of:

inserting the armature within a thermal shielding unit to surround a part of said armature by said shielding; and placing said armature and said shielding within an annealing furnace so that the part of said armature within said thermal shielding unit anneals at a lower temperature than parts of said armature which are not surrounded thereby said shielding.

* * * * *